US005664352A

United States Patent [19]

Beckman

[11] Patent Number: 5,664,352

[45] Date of Patent: Sep. 9, 1997

[54] METHOD AND APPARATUS FOR ILLUMINATING ARTWORK BY A NEON TUBE ARRANGEMENT OF SELECTED CONFIGURATION

[76] Inventor: Sue Beckman, 2331 S. Palmetto Ave., South Daytona, Fla. 32119

[21] Appl. No.: 392,034

[22] Filed: Feb. 22, 1995

Related U.S. Application Data

[63] Continuation-in-part of Ser. No. 185,363, Jan. 24, 1994, abandoned.

[51] Int. Cl.[6] ..... G09F 13/26

[52] U.S. Cl. ..... 40/545; 40/716

[58] Field of Search ..... 40/545, 575, 581, 40/714, 716, 768; 362/125, 126, 216, 263, 373

[56] References Cited

U.S. PATENT DOCUMENTS

| | | | |
|---|---|---|---|
| 1,680,633 | 8/1928 | Peters | 40/545 |
| 1,813,759 | 7/1931 | Peters | 40/545 |
| 1,822,980 | 9/1931 | Palmer | 40/545 X |
| 1,882,647 | 10/1932 | Kanolt | 40/575 X |
| 1,939,288 | 12/1933 | Allison | 40/545 |
| 2,010,004 | 8/1935 | Berggren | 362/373 X |
| 2,529,052 | 11/1950 | Sherwood | 40/152.2 X |
| 2,731,749 | 1/1956 | Tarzian | 40/152.2 |
| 3,395,301 | 7/1968 | Ianelli | 362/263 X |
| 3,517,937 | 6/1970 | Glass et al. | 40/152.2 X |
| 3,707,792 | 1/1973 | Mabrey et al. . | |
| 4,185,407 | 1/1980 | Lamb | 40/367 |
| 4,242,821 | 1/1981 | McNeil | 40/571 |
| 4,261,125 | 4/1981 | Rappaport | 40/367 |
| 4,383,382 | 5/1983 | Hegarty | 40/575 X |
| 4,546,420 | 10/1985 | Wheeler et al. | 362/373 X |
| 4,674,211 | 6/1987 | Pratt | 40/564 |
| 4,751,434 | 6/1988 | Helling et al. | 40/152.2 X |
| 4,796,170 | 1/1989 | Pedersen et al. . | |
| 5,074,593 | 12/1991 | Grosso | 40/158.1 X |
| 5,136,492 | 8/1992 | Rush . | |
| 5,201,133 | 4/1993 | Best et al. | 40/158.1 |
| 5,237,765 | 8/1993 | Vargish, II | 40/545 |
| 5,270,910 | 12/1993 | Kile | 40/545 X |

FOREIGN PATENT DOCUMENTS

| | | |
|---|---|---|
| 2335899 | 7/1977 | France . |
| 2183387 | 6/1987 | United Kingdom . |

*Primary Examiner*—Joanne Silbermann
*Attorney, Agent, or Firm*—Julian C. Renfro, Esq.

[57] ABSTRACT

A display arrangement for illuminating posters and other non-opaque planar artwork comprising an item of artwork affixed to an essentially transparent mounting member, and a plurality of precisely configured neon light tubes mounted behind the item of artwork. The light tubes are arranged in a predetermined pattern consonant with the subject matter of the artwork, with each of the light tubes being positioned behind a selected portion of the artwork, to illuminate and enhance such selected portion of the artwork when the light tubes are energized. Another aspect of this invention involves the novel method of mounting non-opaque artwork in a frame; creating a plurality of neon light tubes of selected configuration and color for the illumination of the artwork, with each of such light tubes configured to be consonant with the shape of a particular segment of the artwork and arranged to emit an intended color for the illumination of such segment of the artwork; supporting the light tubes in carefully established relationships on the rear side of the artwork, with each tube maintained in an appropriate positional relationship with a respective segment of the artwork to be illuminated; and providing electric power to the light tubes at the appropriate voltage, to bring about the energization of the tubes as well as the illumination of the selected segments of the artwork.

29 Claims, 3 Drawing Sheets

METHOD AND APPARATUS FOR ILLUMINATING ARTWORK BY A NEON TUBE ARRANGEMENT OF SELECTED CONFIGURATION

RELATIONSHIP TO PREVIOUS APPLICATION

This is to be regarded as a Continuation-in-Part of my patent application entitled "NEON LIGHT DISPLAY BOX AND METHODS," Ser. No. 08/185,363, filed Jan. 24, 1994, which is to be abandoned with the filing of this application.

BACKGROUND OF THE INVENTION

This invention relates to display means and more particularly to a frame structure and method that uses neon lighting to illuminate and enhance artwork such as photographs and similar items representing artistic creativity.

Illuminated display means, such as art boxes, billboards and other frame structures, are common in the prior art, but most such structures use light generated from incandescent or fluorescent light bulbs. Unfortunately, light generated from the latter sources is generally uniform and not sufficiently intense to enhance a display or selected portions thereof, whether the display be a painting, lithograph, poster or photograph.

On the other hand, neon light is more intense than incandescent or fluorescent light, and the neon tubes can be shaped by the use of concentrated heat to desired configurations. By the utilization of different colors, selected portions of the artwork can be emphasized in a most attractive manner.

The prior patented and commercialized art contains display boxes, but none having a similar structure and using neon lights. For instance, Great Britain Patent No. 2,183,387 by Kaisha, dated Jun. 3, 1987, teaches a display light box that illuminates artwork which uses fluorescent lighting and has a different structure than the present invention. U.S. Pat. No. 4,185,407 by Lamb, dated Jan. 29, 1980, and U.S. Pat. No. 4,674,211 by Pratt, dated Jun. 23, 1987, shows a lighted display box for displaying stained glass, but neither of these use neon lights.

U.S. Pat. No. 4,261,125 by Rappaport, dated Apr. 14, 1981, teaches an illuminated display box for transparencies which does not use neon. U.S. Pat. No. 3,707,792 by Mabrey, et al, dated Jan. 2, 1973, teaches an illuminated display cabinet for a building directory. U.S. Pat. No. 4,796,170 by Pedersen, et al, dated Jan. 3, 1989, teaches a display unit for refractive letters which results in a 3-dimensional effect. French Patent No. 2,335,899 published in July 1977 teaches an illuminated box for the public display of posters, but it does not use neon lights. U.S. Pat. No. 4,242,821 by McNeil, Jan. 6, 1981, teaches a lighted display box for inserting pictorials. U.S. Pat. No. 5,136,492, by Rush, dated Aug. 4, 1992, teaches the creation of unusual visual effects by a light display consisting of a neon light tube mounted between two transparent sheets and a box, but this patent involves a significantly different purpose and different structure from the present invention. U.S. Pat. No. 5,237,765 by Vargish II, dated Aug. 24, 1993, teaches a neon tube containing a sign for display within the tube, but it is concerned with flash rate, and has a significantly different structure than the present invention.

The Allison Patent No. 1,939,288 entitled "Indirect Luminous Tube Illumination," which issued Dec. 12, 1933, teaches a display device involving a plurality of parallel contiguous glass bars or rods disposed between front and rear glass plates, with these glass rods being known as canes. A neon tube is disposed behind the glass bar array. A sign carrying a desired message is obtained by designing portions of Allison's front plate to be opaque and other portions to be pervious to light. The patentee mentions that a fiery red color may be obtained by the use of neon, but that the color may be varied by providing tubes filled with other gases; by the use of colored glass rods or canes; or by the use of colored glass in either front or the rear plate. Allison is obviously entirely silent as to the configuring a plurality of neon light tubes into various shapes, in order that particular portions of selected artwork can be illuminated by a neon tube of chosen color.

In addition to the prior patented art, a commercialized sign using neon exists which is sold under the name "New Neon." However, the latter sign differs in many ways from the present invention. The commercial art requires a special stocked face and thus it would not be usable to display famous artwork, lithographs and posters. Furthermore, the sign being displayed is external to the box and thus, not protected from the elements, which is necessary in order to preserve artwork. Thus, the current commercialized art is considerably different in structure and thus, could not be utilized in a manner as can the present invention.

The present invention solves the above problems in a highly advantageous manner, and provides objects summarized and described in detail hereinafter.

SUMMARY OF THE INVENTION

It is a primary goal of the present invention to provide a display arrangement that utilizes carefully selected neon light components for enhancing non-opaque artwork such as photographic prints, paintings, lithographs, posters, and other such items capable of being illuminated from behind.

As will be described in detail hereinafter, my novel display arrangement for illuminating posters and other planar artwork may, in accordance with this invention, comprise a frame having dimensions to appropriately surround the artwork to be displayed. A transparent face plate may be mounted in a front portion of the frame, behind which the artwork is to be mounted. A plurality of support members are positioned in the frame, disposed behind and relatively close to the artwork.

Significantly, a plurality of precisely configured neon light tubes are mounted on these support members, with each of the light tubes being positioned behind a selected portion of the artwork, and with the tubes arranged in a predetermined pattern to illuminate and enhance such selected portions of the artwork by projecting light therethrough. At least some of the light tubes are configured to carefully coincide with particular segments of the artwork to be illuminated and enhanced, and in most instances the light tubes represent at least two different colors. It is important to note that some of the illuminated tubes of the display arrangement may be spaced further from the artwork than others of the illuminated tubes.

As one option, at least one light tube of the illumination arrangement may be of clear glass, with color being determined by the particular inert gas or gases used in the tube. Another option is to make the light tube of colored glass, with the color output being largely determined by the particular glass color used.

Still another option is for color to be determined by the particular fluorescent coating used inside the light tube.

It is well known that when an electric current is passed though a glass tube containing neon gas, a red glow is produced. The color may be varied by changing the composition of the tube; the pressure of the gas; the quantity of mercury used, if any; the use of fluorescent materials, such as phosphors on the interior of the tubes; and the admixture of other gases. Fluorescent light tubes may contain neon, neon & argon, or neon, argon and mercury as the conducting vapors, and by coating the interior of such tubes with selected phosphors, these tubes can be caused to glow with desired pastel colors when the light from within strikes them.

It is thus to be seen that certain chemical compounds have the property of becoming luminous when acted upon by ultra violet radiation. This property is called "fluorescence," and tubing whose interior is coated with these chemicals is called fluorescent tubing. Those skilled in this art know that ultra violet rays are produced when mercury is used in luminous tubing. For example, when a clear glass tube is filled to a low pressure with a neon and argon mixture to which a drop of mercury has been added, the tube glows with a blue color. Compounds of zinc produce various shades of white, whereas compounds of zinc and silicon fluoresce as brilliant greens.

Any time argon alone is being used as the inert gas, it is necessary to add an appropriate amount of mercury to increase the intensity of the light being emitted. During very low temperature conditions, it is desirable to add neon gas to the argon. Other colors are readily obtainable by those skilled in the art.

Not to be confused with the foregoing are fluorescent lamps, widely used in offices, garages, industrial areas and the like, which involve a glass bulb having at its ends, current-emitting devices such as tungsten filament or iron-tube cathodes. Mercury vapor and argon gas are used in a fluorescent lamp, and a phosphor coating on the inside of the glass bulb serves to convert ultraviolet radiation into light. Those familiar with fluorescent lamps know they are divided into hot-cathode lamps and cold-cathode lamps, with the hot-cathode lamp being used in conjunction with a current limiting ballast. I do not use fluorescent lamps as illumination means for my device, for the fluorescent lamps cannot be shaped to the precise contour of a print to be illuminated, and only a very narrow range of colors are available.

With regard to the light tubes of the type I may utilize in the practice of my invention, such tubes are commercially available in which the interiors of the tubes have been coated with any of a wide variety of powders able to cause a tube to emit light of a certain hue or color when the tube has been filled with an appropriate inert gas and then energized with electrical power provided at an appropriate voltage level. The EGL Company, Inc. of 730 South 13th Street, Newark, N.J. 07103 is a well known supplier of clear and coated colored sign tubing, and I have found the neon light tubing supplied by this company to be satisfactory for many purposes.

Selected color can also be achieved for a light tube by wrapping the external surface of the tube with a non-opaque covering of a preferred color, whereas a modification of the extent of the illuminated portion of the tube may be achieved by applying opaque material to the outer surface of the tube.

In order to achieve a desired intensity of the colored light being projected through the artwork, I have found it desirable to mount the light tubes at specified distances behind selected portions of the artwork, rather than mounting all of the light tubes equidistant from the rear side of the art work.

As will be described in some detail hereinafter, it is a principal goal of this invention to configure the illuminating tubes so as to take into close consideration, the subject matter of the artwork to be illuminated, so that when the tubes have been energized at a proper voltage level, selected components or aspects of the artwork will be enhanced with a color or hue most appropriate to the artwork.

The present invention fulfills the above and other objects by providing a light display device utilizing luminous tubing, such as neon tubing, for displaying posters and other planar artwork capable of being illuminated from behind. This novel device may utilize a hollow frame having the general dimensions of the artwork into which the artwork is to be inserted, in certain instances to be disposed behind a transparent face plate. My novel device preferably contains a plurality of holding pieces or support members, preferably tubing made of glass which are attached to and extend from one side or part of the frame to an opposite part of the frame, in a plane behind and separate from the artwork.

Most important to this invention, a plurality of luminous tubes, typically neon tubes, are configured in a manner appropriate to the artwork to be enhanced, and then arranged in a predetermined pattern and in selected multiple colors in order to enhance designated portions or features of the artwork. The terminology "Neon tubes" or "neon light tubes" is in most instances being employed in the commonly used or generic sense in connection with my invention, inasmuch as argon or some other inert gas is often used in the luminous tubes without neon gas actually being present.

The light tubes or luminous tubes are configured in accordance with conventional techniques utilized in the creation of neon tubing, with the properly formed light tubes being positioned in such a manner as to highlight and advantageously illuminate selected portions of the photograph or other artwork.

As is known by those skilled in the art involving neon light tubes, lead glass tubing is used for neon sign work, which is purchased in various sizes ranging from six to twenty millimeters outside diameter. Twelve millimeter tubing is commonly used, typically purchased in four foot lengths.

As the user goes about configuring the illuminating tubes by the use of concentrated heat, typically from a gas flame, to conform to the subject matter of the photograph or other artwork to be illuminated or emphasized, it often becomes desirable to accomplish a welding or splicing together of various sections of tubing. Welds are ordinarily made by the use of a gas burner known as the crossfire, involving one set of burners facing another set of burners, with the air and gas adjusted until the separate flames are long enough to meet at a point midway between the opposite sets of burners. It is thus to be seen that the flames from the opposed burners are focussed at a centerpoint at which the tubes to be secured together are placed when two tubes are to be joined together.

In the printed publication "Instructions for Glassblowing and Manufacture of Neon Tubing" by S. C. Fraser, and published by Northern Advertising Incorporated of Antigo, Wis., 54409, the bending of neon tubing so as to form various shapes, including the letters of the alphabet, are described at some length. Also described are the steps to be taken in pumping the tubes as well as filling the tubes with the selected gases. Such steps are well known in the art, and therefore form no patentable aspect of the instant invention.

Special methods are required to mount the artwork behind the face plate in order to prevent bubbling or wrinkling caused by the warmth generated by neon light tubes. One method involves coating the artwork with an adhesive and then applying pressure in a controlled fashion in order to bond the artwork to the face plate. Another method for protecting the artwork involves encapsulating the artwork between two sheets of plastic. Still another arrangement for protecting the artwork involved mounting the artwork to a mat and then mount it between transparent sheets. The transparent face plate may be made of acrylic, plexiglass, Lexan or a similar suitable material.

I prefer to utilize laminating rollers when securing the artwork to the Lexan or other transparent mounting material, and after starting the Lexan between the rollers, I start an edge of a roll of Opti-Mount UV between the rollers, Opti-Mount UV being the tradename of a product produced by Minnesota Mining and Manufacturing Co. As the Lexan moves between the rollers and the roll of Opti-Mount UV starts to unwind, I then introduce one edge of the artwork to be mounted. The artwork continues to move with the Lexan between the rollers and because of the pressure asserted by the rollers, the artwork is secured by the Opti-Mount UV to the Lexan in a highly satisfactory bubble-free, wrinkle-free manner.

It is therefore to be seen that a principal object of this invention is to provide a display arrangement involving the configuring of the illuminating tubes with the subject matter of an item of artwork being taken into close consideration, so that selected components or aspects of the item of artwork can be enhanced with a color or hue most appropriate to the artwork.

Another object of the present invention is to provide a plurality of precisely configured neon light tubes mounted on support members, with each of such light tubes being positioned behind a selected portion of artwork to be displayed, and with the light tubes arranged in a predetermined pattern so that when energized at an appropriate voltage level, such light tubes will illuminate and enhance such selected portions of the artwork.

Still another object of this invention is to provide a display box that can be customized in a manner to enhance certain desired portions or features of the artwork with a carefully selected color and an appropriate degree of intensity.

Yet another object of the present invention is to provide such a display box which has all components internal to the display means so that it can be easily hung on walls for display, or utilized on a billboard.

A still further object of the present invention is to provide one or more methods for mounting such artwork to avoid bubbling and wrinkling of the artwork.

A still further object of this invention is to provide a novel method for creating a novel display arrangement for artwork, involving the steps of creating a plurality of neon light tubes of selected color and configuration, supporting the light tubes in carefully established relationship to the artwork, keeping such tubes at selected positional relationships with respect to the artwork, and selectively energizing such tubes at an appropriate voltage level, to bring about the illumination thereof.

Another object of this invention involves the novel method of providing illumination for artwork by the use of neon light tubes projecting light through the artwork, comprising the steps of mounting non-opaque artwork in a frame; creating a plurality of neon light tubes of selected configuration and color for the illumination of the artwork, with each of such light tubes being configured to be consonant with the shape of a particular segment of the artwork, and arranged to emit an intended color for the illumination of such segment of the artwork; supporting the light tubes in carefully established relationships on the back side of the artwork, with each tube maintained in an appropriate positional relationship with a respective segment of the artwork to be illuminated; and applying electric power to the light tubes, to bring about the illumination of the tubes and the selected segments of the artwork.

These and other objects, features and advantages of this invention will become more apparent as the description proceeds.

DETAILED DESCRIPTION

Figure 1A:
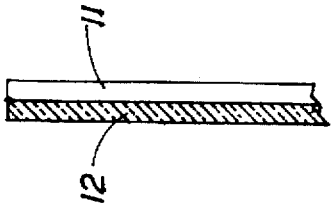
FIG. 1*a* is a cross-sectional view illustrating how in accordance with one embodiment of my invention, the front or face of a piece of artwork to be displayed can be bonded to a sheet of transparent mounting material.
Figure 1B:
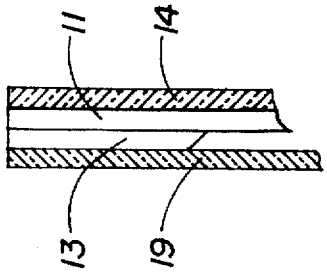
FIG. 1*b* is a cross-sectional view of an upper part of a piece of artwork, illustrating how in accordance with another embodiment of my invention, the back side of the artwork can be bonded to a sheet of transparent mounting material, and a mat placed around the front edges of the piece of artwork, with an unbonded sheet of transparent material then placed in front of the mat.
Figure 1:
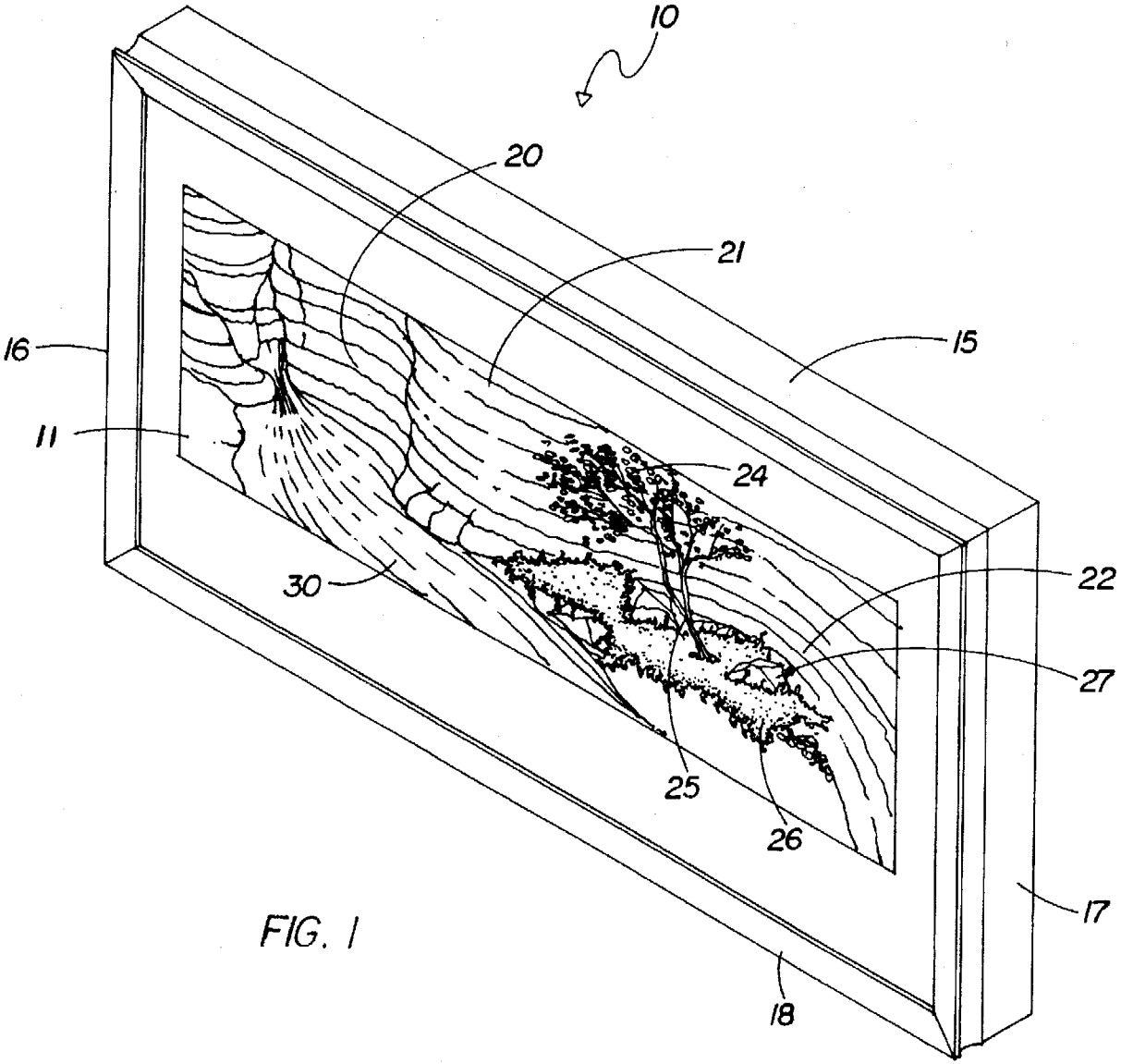
FIG. 1 is a perspective view of a preferred embodiment of my invention, showing exemplary artwork in the nature of a photographic color print, selected portions of which are illuminated from behind by the use of neon light tubes.

With initial reference to FIG. 1, it will be seen that I have provided a display box or frame 10 designed to contain on a front panel thereof, a color print 11 or other form of artwork through which a certain amount of light may manifest itself. The back or rear side of the color print 11 is to be illuminated, in accordance with this invention, by the utilization of luminous tubing hereinafter referred to as "neon tubing" or "neon light tubing." The neon light tubing is to be installed in a carefully positioned array in a rear portion of the box or frame 10, in accordance with a procedure to be described shortly.

Figure 2:
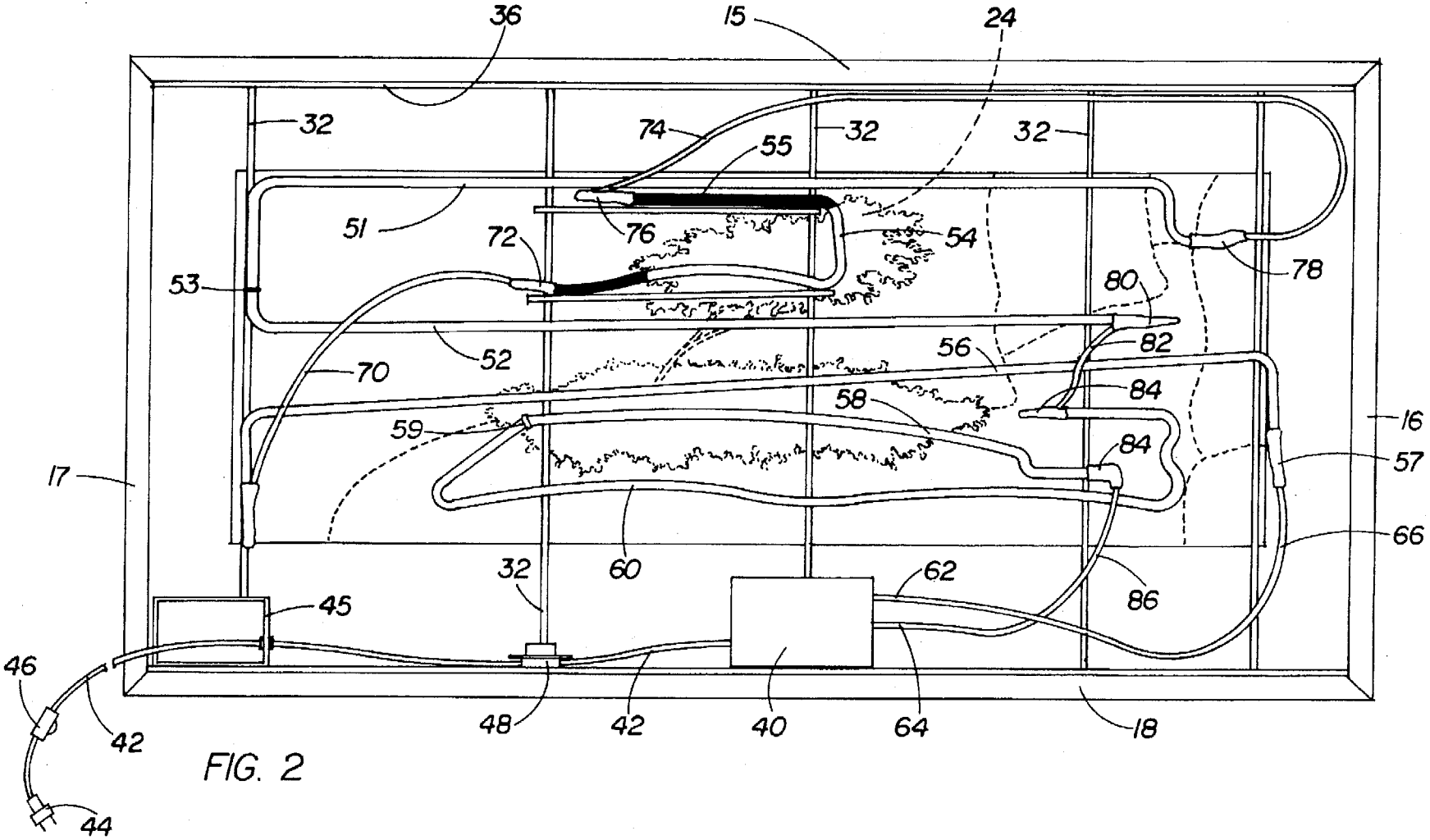
FIG. 2 is a rear view of the preferred embodiment illustrated in FIG. 1, with it to be understood that the positioning of neon light tubes of carefully selected color closely coincides with the location of specific portions of the artwork to be illuminated.
Figure 3:
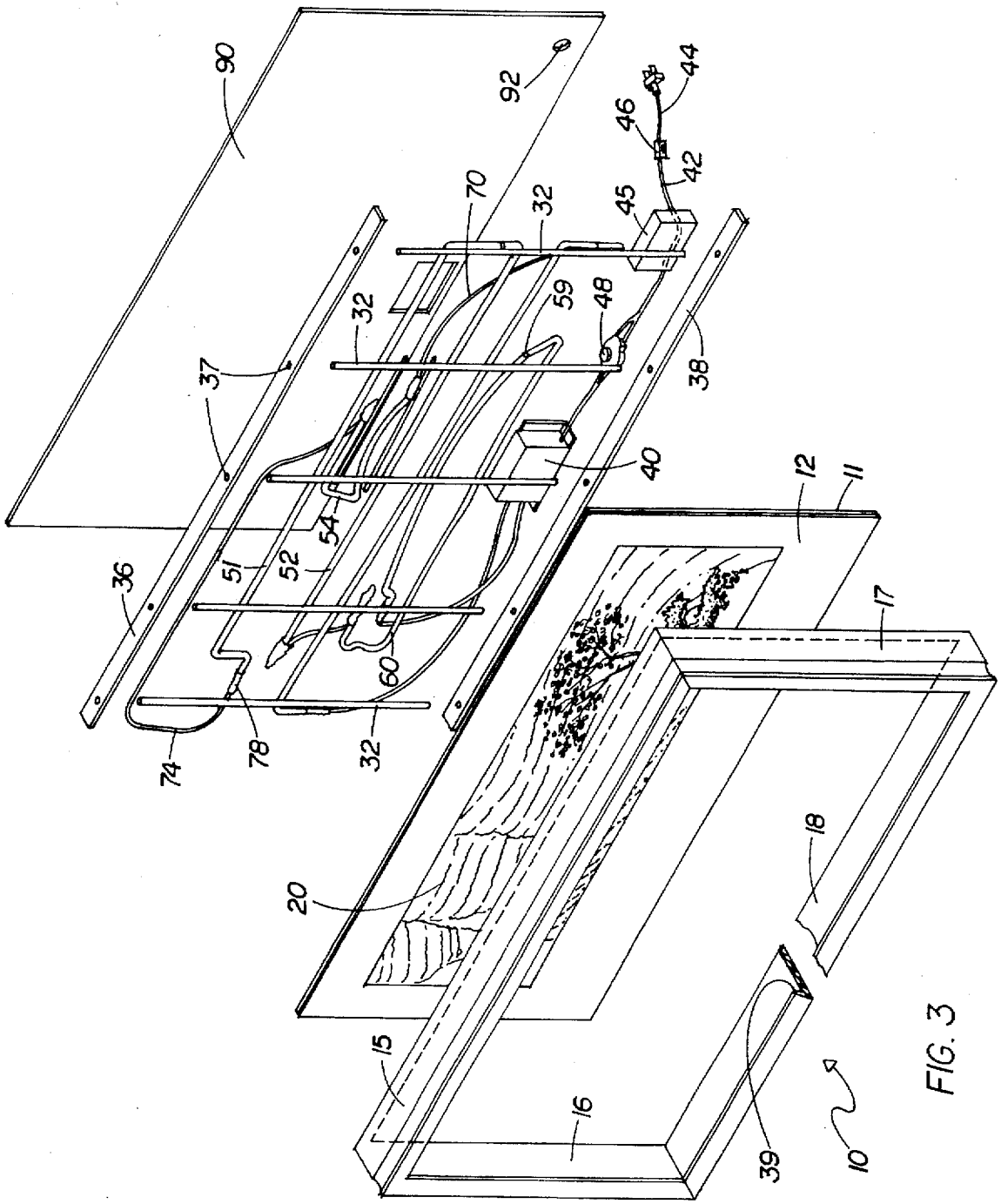
FIG. 3 is a view revealing the significant components of my invention arrayed in an exploded relationship, thus to further reveal that the positioning of the appropriately configured light tubes closely coincides with the specific portions of the artwork to be illuminated.

The display box 10 can be made up of a top member 15, side members 16 and 17, and a bottom member 18, latter member not being fully visible in FIG. 1, but illustrated in FIGS. 2 and 3. The top, side and bottom members may have substantial depth in the thickness direction, so that a number of neon light tubes can be readily accommodated inside the frame, placed at varying distances from the artwork; note FIG. 4.

In accordance with one embodiment of this invention, the item of artwork 11 is mounted on a transparent mounting member 12, such as a sheet of acrylic or Lexan, as shown in FIGS. 1*a* and 3. Typically the face or front of the artwork is firmly attached to the transparent mounting member by the use of a material such as Opti-Mount UV which, as previously mentioned, is a tradename of a product by Minnesota Mining and Manufacturing Co, marketed in dimensions including 36 inch as well as 42 inch widths.

On the other hand, when a mat 13 is to be used around the four front edges of the artwork, in the general manner indicated in FIG. 1*b*, I usually secure the back or rear side of the artwork to the transparent mounting member. The bonding of the rear side of the item of artwork 11 to the transparent mounting member 14 provides stability to the artwork as well as permits light from the neon light tubes to be manifested through the artwork.

In the instance in which the rear side of the artwork 11 is bonded to the transparent mounting material 14, I utilize, as depicted in FIG. 1*b*, an unbonded sheet 19 of transparent mounting material in the front of the frame, behind which the front of the artwork is placed, with the mat 13 residing therebetween, extending around the four edges of the artwork. In this arrangement, the front of the artwork 11 does not adhere to either the mat 13 nor to the transparent mounting material, and the desired arrangement of components is brought about by the mechanical relationship of the artwork, the mat and the unbonded front sheet of transparent material 19 to the frame 10.

Figure 4:
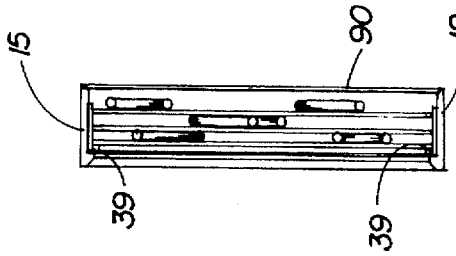
FIG. 4 is an edge view, revealing that the neon tubes may be placed at varying distances from the artwork, thus to assist in providing illumination of varying intensity behind the artwork.

An inturned member 39, in the nature of a shoulder and referred to as a rabbet, extends around the front edges of the top, side and bottom members of the frame, in the manner indicated in FIGS. 3 and 4. It is against the rabbet 39 that the edges of the transparent mounting material 12 reside when the arrangement of FIG. 1*a* is involved, and against which the edges of the unbonded front member 19 reside when the arrangement of FIG. 1*b* is involved.

The item or piece of artwork 11 and the lexan bonded thereto may be held firmly in place against the rabbet 39 in the front of the frame by running a bead of silicone cement around the rear edges of the artwork, where these edges contact the interior portions of the frame 10. Alternatively, small nails or tacks may be driven into interior portions of the frame in order to hold the artwork securely in the intended location in the front part of the frame.

Although artwork of a wide range of types may be utilized in accordance with this invention, one preferred type of artwork involves a photographic print made utilizing non-opaque paper best described as poster paper. Paper of a wide variety of weights may be utilized, with paper of 100 pound weight typically being the heaviest I utilize in the practice of this invention. Paper heavier than this is likely to block out too much light. Artwork can take other forms as long as it is not of such a nature as to reveal brush strokes, with one particularly important criteria being that the artwork must not trend so closely in the direction of opaqueness as to prevent the light from the luminous tubes manifesting itself through the artwork. On the other hand, photographic transparencies usually cannot be satisfactorily utilized in accordance with this invention inasmuch as the positioning of the luminous tubes often tends to be visible through the transparency, thereby detracting from the beauty of the scene. I have found that canvas is usually an undesirable surface inasmuch as the porosity of the canvas serves as a distraction from the scene being displayed. On the other hand, I have found that certain rice paper usually forms a very satisfactory surface upon which artwork can be created.

When the brushstrokes of artistic works created by the use of watercolors or acrylics would be visible, it is desirable to first photograph the artwork and then print the artwork on sensitized paper of the appropriate weight.

With momentary reference back to FIG. 1, when the color print or other item of artwork does not extend the full height and the full width of the frame 10, and a blank border surrounds the edges of the print, it is usually desirable to use an opaque member on certain portions of the back side of the print, to prevent the outline of the transformer utilized to generate the high voltage needed for the illumination of the neon light tubes being visible from the front side of the print.

Turning now to the specific illumination arrangement involving luminous tubing that I utilize in accordance with this invention, each tubing component consists of a length of properly formed glass tubing, at each end of which an electrode is attached. The electrodes are hollow metal cylinders to which lead-in wires are fastened. The lead-in wires extend through the sealed ends of the tube, and connection to the source of current is made by means of such wires, in accordance with well known techniques. Electric power of sufficiently high voltage for the energization of the neon light tubes is obtained by the use of the aforementioned transformer, described hereinafter in some detail.

It is obvious that the luminous tubes must be carefully selected as to color, bent into the appropriate configuration, and thereafter precisely positioned with regard to the specific subject matter of the artwork to be displayed.

It is to be understood that the artwork 11 depicted in FIG. 1 involves a color print of a scene 20 selected as an example in order to explain a basic form of my invention, and I am in no way to be limited to a scene of this type, nor to any other type of subject matter, for my invention may be used with artwork of an extremely wide variety, as long as such artwork is susceptible of being illuminated from behind.

From the exemplary color print 11 depicted in FIG. 1 it will be noted that the subject matter may involve a scene 20 in which the dark upper walls 21 of a canyon are to be illuminated with a relatively warm color, such as coral or pink, whereas the lower canyon walls 22 are to be illuminated with a somewhat less warm color, such as orange, or a combination of orange and yellow.

The leaves 24 of the tree 25 are closely grouped, and are most effectively illuminated with turquoise. This is accomplished in accordance with this invention by shaping the luminous tubing into a generally U-shaped configuration, thus to confine or localize the illumination to the leaves. Any undesirable overflow of color to other parts of the color prints is minimized by the selective utilization of opaque material on exterior portions of the tubing.

A portion of the low bushes 26 and the rocks 27 along the bottom of the canyon wall are to be illuminated with a bright color, such as yellow, or yellow combined with turquoise or light blue, whereas the stream 30 is to be illuminated with a relatively bright color, such as white.

As will become more apparent as the description proceeds, it is desired to illuminate the particular portions of the selected scene in a highly advantageous and pleasing manner. One manner of this being accomplished in accordance with this invention is by the use of precoated neon tubes that have been positioned on the backside of the display box 10 in such a manner as to provide a color that in each instance has been carefully selected to best illuminate specific, selected portions of the color print. Alternatively, the tubing may be made of glass that has been precolored, or the glass can be uncolored, and the desired color achieved by the selective mixing of the inert gases.

The display arrangement for illuminating artwork may, in accordance with this invention, involve light tubes representing at least two different colors. One embodiment of my invention may for example, involve at least one tube of the display being made of clear glass, with color being determined by the particular inert gas used in the tube, whereas another embodiment may involve the light tube being made of colored glass, with color being solely determined by the color of the particular glass used. As indicated earlier, another important embodiment in accordance with this invention may involve the color being determined by mixing different inert gases and utilizing such mixture of gases in the tube.

Still another important embodiment may involve light tubes whose interiors have been coated with a powder causing each tube to adopt fluorescent properties such that they will emit light of a certain hue or color when the tube has been filled with an appropriate inert gas and thereafter energized at a sufficiently high voltage level.

A different way of achieving desired color may involve wrapping the external surface of a light tube with a non-opaque covering of selected color, and a somewhat similar technique may be utilized when it is desired that the illuminated portion of the tube be modified or limited, which is achieved by applying opaque material to the outer surface of the light tube.

Reference is now made to FIG. 2 of the drawing, with it being important to note that this figure represents a left to right reversal of the subject matter of the color print 11 depicted in FIG. 1 inasmuch as FIG. 2 reveals the color print as viewed from the backside.

I have earlier mentioned that I prefer to utilize laminating rollers when securing the artwork to the Lexan or other mounting material, and after starting the Lexan between the rollers, I start an edge of a roll of Opti-Mount UV between the rollers. As the Lexan moves between the rollers and the roll of Opti-Mount UV starts to unwind, I then introduce one edge of the artwork to be mounted. The artwork continues to move with the Lexan and the Opti-Mount UV between the rollers and because of the pressure asserted by the rollers, the artwork is secured by the Opti-Mount UV to the Lexan in a highly satisfactory bubble-free, wrinkle-free manner.

A close inspection of FIG. 2 reveals that a series of holding pieces or support members 32 are utilized in order that the selected components of luminous tubing can be supported in a manner to best illuminate specific locations of the color print. For the reason of avoidance of creating a shadow, the several support members 32 are of glass, for by being transparent, the utilization of such support members is not apparent during a viewing of the front side of the illuminated color print.

As mentioned hereinabove, FIG. 2 represents a left to right reversal of the subject matter of the color print indicated in FIG. 1 inasmuch as FIG. 2 reveals the color print viewed from the backside. It has also been mentioned that I employ the terminology "neon tubes" or "neon light tubes" in the commonly used or generic sense in connection with the illuminating tubes utilized with my invention, for argon or some other inert gas is often used without neon gas actually being present.

FIG. 2 further reveals that a neon light tube 51 is located in an upper part of the frame and extends for substantially the full width of the frame. This light tube may for example be 15 mm in diameter, with the interior of the tube coated with turquoise powder.

Because light tube 51 is filled with neon gas which, when energized, produces a red color, the tube 51 takes on a coral or pink, for a highly desirable illumination of the upper canyon walls 21 depicted in FIG. 1.

Continuing with a consideration of FIG. 2, the laterally extending light tube 52 is directly connected at 53 to tube 51, such that the gas utilized to illuminate the tubes is common to both tubes. The interior of tube 52 is coated with "clear gold," so that when pumped, an color orange results. As is well known in the neon art, when adjacent light tubes are interconnected, they can be pumped with the same gas, despite the fact that because of their internal coating, they take on respective colors that are different. Tube 52 may be somewhat smaller diameter than tube 51, being for example 12 mm in diameter, thus to confine the orange color to a desired extent, and to prevent an overflow of color into locations not desired.

It has been previously mentioned that the leaves 24 of the tree 25 are to be illuminated without an overflow of color being involved. For that reason, I configure the relatively small tube 54 visible in FIG. 2 to have a generally U-shaped configuration, so that substantial portions of the light tube 54 will be located directly behind the leaves 24. The interior of tube 54 has a turquoise coating and is pumped with argon gas, which possesses a light blue color, for a highly appropriate illumination of the leaves. Recognizing that it is not always possible to configure a neon tube to precisely coincide with the component or components to be illuminated, I utilize a black, opaque compound on portions 55 of the tube 54 extending beyond the leaves 24, thus to avoid a dissemination of color that is too wide for the particular application.

With reference to light tube 56, it will be noted that this tube slopes for substantially the full width of the color print, and it serves to illuminate the upper portion of the low bushes 26 as well as the rocks 27 appearing in the color print 11. The interior of light tube 56 is coated with "clear gold" and because it is filled with argon, it glows with a yellow color for a desired illumination of the low bushes 26 and the rocks 27.

Continuing with FIG. 2, it will be noted that light tubes 58 and 60 are joined together at 59, meaning that they can be pumped with the same gas, argon in this instance. The interior of light tube 58 is coated with turquoise, whereas the interior of tube 60 is coated with white. As a consequence, tube 58 glows with a turquoise or light blue color, for a further illumination of the low bushes 26, whereas light tube 60, being white, serves to brightly illuminate the stream 30.

Figure 5:
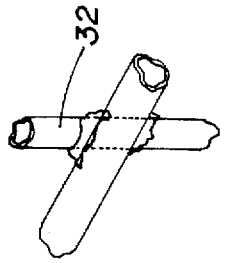
FIG. 5 is a fragmentary view, showing how a typical neon light tube can be affixed to a typical supporting tube.

It will further be noted in FIG. 2 that the support members 32 have been positioned in each instance so as to form a proper support for light tubes 51 through 60, with the support members being secured to the neon tubes by a cement such as silicone cement; note FIG. 5. This type of cement is widely used, being marketed under brand names such as G. E. Household Silicone cement.

Also to be noted in this figure is transformer 40, which is supplied with 110 volts AC by means of an electric cord 42. Although I am not to be limited to the use of transformers manufactured by any one supplier, I have found the transformers manufactured by TFT Transfotec International, 559 Industriel Blvd., St. Eustache, Quebec, Canada to be particularly satisfactory in most instances.

Depending upon the footage of neon tube being used in a given installation, either transformer Model 04-6000V or 06-9000V may be used, with each of these transformers having an operating temperature of 15°–40° C. (59°–104° F.), with a rise of +20° C. above ambient.

As one example, when working with clear, fluorescent red or neon fluorescent gold neon tubing of 12 mm size, the transformer 04-6000V will be appropriate for up to 16 feet of tubing, whereas transformer model 06-9000V will be appropriate for up to 26 feet of tubing of 12 mm size. On the other hand, when working with clear or fluorescent mercury filled tubes (all colors), transformer model 04-6000V is appropriate for 12mm tubing up to 19 feet in length, whereas transformer model 06-9000V is appropriate for 12 mm tubing up to 32 feet in length.

As shown in FIG. 2, an overheat switch 48 is typically interposed in the cord 42 so as to cut off power to the transformer should for any reason an overheating condition occur.

The secondaries 62 and 64 of the transformer 40 are utilized for supplying electric power at the proper high voltage for the energization of the neon light tubing, so that light of the desired selected color will be emitted. GTO wire 66 is utilized for connecting secondary terminal 62 of the transformer to the terminal end 57 of tube 56.

GTO wire 70 is utilized to connect the opposite end of light tube 56 to the lower terminal 72 of the U-shaped tube 54, with GTO wire 74 being utilized to connect the upper terminal 76 of U-shaped light tube 54 to terminal 78 of tube 51. Opaque material may be applied at certain locations to the U-shaped tube 54, so that its light will not extend beyond the leaves 24 of the tree 25 depicted in the color print 11.

It has already been mentioned that light tube 51 is interconnected at 53 with tube 52 so as to share the same pumping gas (neon), whereas the far right end of tube 52 is provided with an electric terminal 80 to which GTO wire 82 is connected in order to provide continuity by its connection to terminal 84 of tube 60.

Light tube 60 is of course directly connected at 59 to tube 58 so as to share the pumping gas (argon) therewith, with the remote end of tube 58 having a terminal 84 to which GTO wire 86 is connected. GTO wire 86 is connected to secondary terminal 64 of the transformer 40, so as to complete the high voltage circuit from one secondary terminal, through all six of the tubes in a series array, and thence back to the other secondary terminal of the transformer.

With reference now to FIG. 3, I show in an exploded relationship, the manner in which the previously described components are utilized, such as the box or frame 10, the color print 11 mounted upon the acrylic sheet 13, the transparent mounting member, and the array of neon light tubes whose particular positions reflect a preascertained relationship to the various portions and aspects of the color print 11.

Of some importance is the fact that in FIG. 3 I reveal the use of an upper foam board 36 into which a selected array of holes 37 have been formed, with a substantially identical array of holes being formed in the lower foam board 38, thus to form appropriate means for the effective mounting of the support members or holding pieces 32 that support the luminous tubes. As a result of this arrangement, the support rods 32 are mounted in a sturdily constructed parallel array, so as to form an adequate support for the neon light tubes, which are positioned at distances from the artwork best suited for the appropriate illumination of the color print 12.

The transformer 40 is supplied with 110 volts AC by the use of the previously mentioned electric cord 42, which passes through a terminal box 45 of plastic construction, with the end of the cord 42 being equipped with a plug 44. When the transformer is energized at the appropriate voltage level, it will cause the light tubes, typically connected in a series relationship, to illuminate selected portions of the artwork.

Though normally not necessary, a cooling fan may be electrically connected to the transformer to keep the interior of the display device cool enough to prevent damage to the artwork from the heat of the neon light tubes, with a cooling arrangement typically being needed only when a comparatively large number of tubes are utilized in a relatively small volume or space.

As depicted in FIGS. 2 and 3, a line switch 46 may be utilized in the cord 42 so that the tubes may selectively be energized and de-energized, and as previously mentioned, an overheat switch 48 may also be utilized in the cord 42. The switch 48 serves to remove power from the display device should the heat within the frame reach a predetermined temperature.

An opaque backer 90 of a size to fit into the rear side of the display box or frame 10 is utilized for effecting closure of the display box, as depicted in FIG. 3. As is apparent, a hole 92 is cut into one location of the backer 90, through which the line cord 42 is passed. A cutout may also be provided for providing access to the transformer.

As depicted in FIG. 4, the luminous tubes may be placed at carefully determined distances from the item of artwork, so that a selected degree of light intensity will be manifested through what may be regarded as the most significant portions of the artwork.

At this point it should now be obvious that the present invention includes the novel method of providing illumination for artwork by the use of neon light tubes projecting light through the artwork, which method involves the steps of mounting non-opaque artwork in a frame; creating a plurality of neon light tubes of selected configuration and color for the illumination of the artwork, with each of such light tubes being configured to be consonant with the shape of a particular segment of the artwork, and arranged to emit an intended color for the illumination of such segment of the artwork; supporting the light tubes in carefully established relationships on the back side of the artwork, with each tube maintained in an appropriate positional relationship with a respective segment of the artwork to be illuminated; and then selectively applying electric power to the light tubes, to bring about the energization of the light tubes and the illumination of selected segments of the artwork.

I claim:

1. A display arrangement for illuminating planar artwork having both width and height comprising:

an item of artwork affixed to an essentially transparent mounting member, with at least some portions of the artwork having color, a plurality of precisely configured neon light tubes mounted in a non-parallel array behind said item of artwork, said light tubes being arranged in a predetermined pattern consonant with the subject matter of the artwork, with each of said light tubes being positioned behind a selected portion of the artwork, to illuminate and enhance such selected portions of the artwork, said item of artwork involving at least two different portions, with a first of said portions to be illuminated by a neon tube of a first color, and a second of said portions to be illuminated by a neon tube of a second color, at least one of said neon tubes being in sloped relation to said item of artwork and extending for a substantial portion of the width of said artwork, and means for selectively applying electric power to each of said light tubes, to cause the illumination thereof and the projection of light through the respective portion of the item of artwork.

2. The display arrangement for illuminating posters and other planar artwork as recited in claim 1 in which said artwork has a front side and a back side, and said transparent mounting member is affixed to the front side of said artwork.

3. The display arrangement for illuminating posters and other planar artwork as recited in claim 1 in which said artwork has a front side and a back side, and said transparent mounting member is affixed to the back side of said artwork.

4. The display arrangement for illuminating posters as defined in claim 1 in which at least one of said light tubes is clear glass, with color being determined by the particular inert gas utilized in the tube.

5. The display arrangement for illuminating posters as defined in claim 1 in which at least one of said light tubes is made of colored glass, with color being determined by the particular glass color used and the inert gas utilized in the tube.

6. The display arrangement for illuminating posters as defined in claim 1 in which the interior of at least one of said light tubes is coated with a powder designed to emit light of a particular color when the tube is energized.

7. The display arrangement for illuminating posters as defined in claim 1 in which color is determined by a mixture of an inert gas with mercury.

8. The display arrangement for illuminating posters as defined in claim 1 in which color is achieved by wrapping the external surface of at least one of said light tubes with a non-opaque covering of selected color.

9. The display arrangement for illuminating posters as defined in claim 1 in which the illuminated portion of at least one of said light tubes is modified by applying opaque material to the outer surface of the tube.

10. The display arrangement for illuminating posters as defined in claim 1 in which said light tubes are placed at varying distances from said artwork, in the interests of moderating the intensity of light projected through the artwork.

11. The display arrangement for illuminating planar artwork as recited in claim 1 in which opaque material is utilized on portions of certain of the neon tubes, to avoid a dissemination of color that is too wide for the particular application.

12. A display arrangement for illuminating planar artwork comprising:

an item of artwork affixed to an essentially transparent mounting member, a frame having width and height and being dimensioned to surround said item of artwork, a plurality of support members mounted in said frame, disposed behind and relatively close to the item of artwork, and a plurality precisely-configured light tubes supported in said frame in a close relationship to said artwork, with said light tubes arranged in a configuration consonant with the subject matter of said artwork, said item of artwork having at least two different portions, with a first of said portions to be illuminated by a neon tube of a first color that is supported closely adjacent said first portion, and a second of said portions to be illuminated by a neon tube of a second color supported closely adjacent said second portion, at least one of said neon tubes sloping with respect to said frame for at least a portion of the width of the item of artwork, said light tubes thus being arranged in a predetermined pattern to illuminate and enhance such selected portions of the item of artwork, and means for selectively applying electric power at an appropriate voltage to said light tubes, to cause the illumination thereof and the projection of light of selected color through said first and second portions of the item of artwork.

13. The display arrangement for illuminating posters and other planar artwork as recited in claim 12 in which said item of artwork has a front side and a back side, and said transparent mounting member is affixed to the front side of said item of artwork.

14. The display arrangement for illuminating posters and other planar artwork as recited in claim 12 in which said item of artwork has a front side and a back side, and said transparent mounting member is affixed to the back side of said item of artwork.

15. The display arrangement for illuminating posters as defined in claim 12 in which at least some of said light tubes are configured to carefully coincide with a particular segment of the item of artwork to be illuminated and enhanced.

16. The display arrangement for illuminating posters as defined in claim 12 in which the interior of at least one of said light tubes is coated with a powder designed to emit light of a particular color when the tube is energized.

17. The display arrangement for illuminating posters as defined in claim 12 in which at least one of said light tubes is clear glass, with color being determined by the particular inert gas used in the tube.

18. The display arrangement for illuminating posters as defined in claim 12 in which at least one of said light tubes is made of colored glass, with color being determined by the particular glass color used.

19. The display arrangement for illuminating posters as defined in claim 12 in which the color of at least one of said light tubes is at least partially determined by the particular inert gas used in the tube.

20. The display arrangement for illuminating posters as defined in claim 12 in which color is determined by a mixture of an inert gas with mercury.

21. The display arrangement for illuminating posters as defined in claim 12 in which color is achieved by wrapping the external surface of at least one of said light tubes with a non-opaque covering of selected color.

22. The display arrangement for illuminating posters as defined in claim 12 in which the illuminated portion of the light tube is limited by the application of opaque material to the outer surface of the tube.

23. The display arrangement for illuminating posters as defined in claim 12 in which said light tubes are placed at varying distances from said artwork.

24. The display arrangement for illuminating planar artwork as recited in claim 12 in which opaque material is utilized on portions of the neon tubes, to avoid a dissemination of color that is too wide for the particular application.

25. The method of providing illumination for selected portions of an item of color artwork by the use of neon light tubes comprising the steps of:

a. mounting non-opaque artwork in a frame;

b. creating a plurality of neon light tubes of selected color and configuration in an essentially non-parallel array, with such light tubes being configured to be consonant with particular segments of the artwork to be illuminated, and of a color desirable for the enhancement of the segments;

c. supporting said light tubes on one side of said artwork, in a carefully established relationship to the artwork, keeping such tubes at selected positional relationships with respect to the segments of the artwork to be illuminated;

d. applying opaque material to certain locations on said light tubes, as necessary to prevent a dissemination of color too wide for the particular location, and e. selectively energizing said light tubes by the use of electric power of the appropriate voltage, to bring about the illumination thereof, and the illumination of the segments of the artwork.

26. The method of providing illumination for selected portions of an item of color artwork by the use of neon light tubes projecting light through the artwork, comprising the steps of:

a. mounting non-opaque artwork in a frame;

b. creating a plurality of neon light tubes of selected configuration and color for the illumination of the artwork, with each of such light tubes being configured to be consonant with the shape of a particular segment of the artwork, and arranged to emit an intended color for the illumination of such segment of the artwork;

c. supporting said light tubes in carefully established, essentially non-parallel relationships on the back side of the artwork, with each tube maintained in an appropriate positional relationship with a respective segment of the color artwork to be illuminated;

d. applying opaque material to certain locations on said light tubes, as necessary to prevent a dissemination of color too wide for the particular location, and e. providing electric power to said light tubes at the appropriate voltage, to bring about the energization of said tubes as well as the illumination of the selected segments of the color artwork.

27. The method of providing illumination for selected portions of an item of color artwork by the use of neon light tubes projecting light through the artwork, comprising the steps of:

a. mounting non-opaque artwork on a transparent mounting member;

b. installing said artwork on its mounting member in a frame;

c. creating a plurality of neon light tubes of selected configuration and color for the illumination of said artwork, with each of such light tubes being configured to be consonant with the shape of a particular segment of the artwork, and arranged to emit an intended color for the illumination of such segment of the artwork;

c. supporting said light tubes in carefully established, essentially non-parallel relationships on the back side of the artwork, with each tube maintained in an appropriate positional relationship with a respective segment of the color artwork to be illuminated;

d. applying opaque material to certain locations on said light tubes, as necessary to prevent a dissemination of color too wide for the particular location, and e. providing electric power to said light tubes at the appropriate voltage, to bring about the energization of said tubes as well as the illumination of the selected segments of the color artwork.

28. The method of providing illumination for selected portions of an item of artwork by the use of neon light tubes as recited in claim 27 in which the mounting the artwork to the transparent mounting member involves the step of mounting the face of the artwork to the transparent mounting member.

29. The method of providing illumination for selected portions of an item of artwork by the use of neon light tubes as recited in claim 27 in which the mounting the artwork to the transparent mounting member involves the step of mounting the rear side of the artwork to the transparent mounting member.

* * * * *